US009265324B2

(12) United States Patent
Wigmore

(10) Patent No.: US 9,265,324 B2
(45) Date of Patent: Feb. 23, 2016

(54) COMB

(75) Inventor: Roger Wigmore, Essex (GB)

(73) Assignee: DENMAN INTERNATIONAL LIMITED, Bangor, County Down (GB)

( * ) Notice: Subject to any disclaimer, the term of this patent is extended or adjusted under 35 U.S.C. 154(b) by 0 days.

(21) Appl. No.: 13/877,331

(22) PCT Filed: Oct. 12, 2011

(86) PCT No.: PCT/EP2011/067814

§ 371 (c)(1),
(2), (4) Date: Apr. 1, 2013

(87) PCT Pub. No.: WO2012/049212

PCT Pub. Date: Apr. 19, 2012

(65) Prior Publication Data

US 2013/0220359 A1 Aug. 29, 2013

(30) Foreign Application Priority Data

Oct. 12, 2010 (GB) ..... 1017161.9

(51) Int. Cl.
*A45D 24/34* (2006.01)
*A45D 24/36* (2006.01)
*A45D 24/10* (2006.01)

(52) U.S. Cl.
CPC ..... *A45D 24/36* (2013.01); *A45D 24/10* (2013.01)

(58) Field of Classification Search
CPC ..... A45D 24/26; A45D 24/10; A45D 24/38; A45D 24/36; B26B 21/12; B26B 21/125; B26B 13/24; B26B 19/20; B26B 21/42
USPC ..... 132/213, 212, 213.1, 214, 215, 219, 132/106, 107, 148–150, 147, 124; 30/30, 30/34.05, 34.2, 55, 195, 200, 233, 233.5, 30/282–286; D28/21, 25, 44.2, 45, 52
See application file for complete search history.

(56) References Cited

U.S. PATENT DOCUMENTS

| | | | | | |
|---|---|---|---|---|---|
| 938,040 | A | * | 10/1909 | Caldwell | 132/148 |
| 1,132,699 | A | * | 3/1915 | Wright | 132/148 |
| 1,182,242 | A | * | 5/1916 | Bennett | 132/145 |
| 1,332,587 | A | * | 3/1920 | Yeomans | 30/30 |
| 1,347,260 | A | | 7/1920 | Desmarais | |

(Continued)

FOREIGN PATENT DOCUMENTS

| | | |
|---|---|---|
| FR | 1233653 | 10/1960 |
| JP | S4928460 | 3/1974 |

OTHER PUBLICATIONS

Search Report Issued by UK Patent Office, dated Feb. 10, 2012.

(Continued)

*Primary Examiner* — Rachel Steitz
(74) *Attorney, Agent, or Firm* — Raymond A. Nuzzo

(57) ABSTRACT

A comb having an elongate spine, a plurality of tines extending from the spine, and a guide for use in association with a scissors or a clippers. The guide has a shelf that is tapered in three dimensions from a first end towards a second end and has a widest point closer to the second end than the first end. The guide extends along a portion of the length of the spine and extends from the surface which is generally transverse to the longitudinal axis of the spine such that the scissors or clippers may be supported on the shelf as the scissors or clippers are moved in a horizontal direction.

2 Claims, 6 Drawing Sheets

(56) References Cited

U.S. PATENT DOCUMENTS

| | | | | | |
|---|---|---|---|---|---|
| 1,359,343 | A | * | 11/1920 | Dodge | 132/124 |
| 1,440,015 | A | | 12/1922 | Kaniefski | |
| 1,457,726 | A | | 6/1923 | Cornellier | |
| 1,623,292 | A | * | 4/1927 | Widdows | 132/148 |
| 1,737,461 | A | * | 11/1929 | Kassow | 132/124 |
| 1,891,303 | A | | 12/1932 | Cazez | |
| 2,143,808 | A | * | 1/1939 | Swanow | 132/124 |
| 2,325,246 | A | * | 7/1943 | Halen | 132/135 |
| 2,510,943 | A | * | 6/1950 | Bertrand | 132/148 |
| 2,638,907 | A | | 5/1953 | Boyer | |
| 2,678,047 | A | * | 5/1954 | Garfield | 132/219 |
| 2,774,359 | A | * | 12/1956 | Foley | 132/129 |
| 2,830,600 | A | * | 4/1958 | Churchillo | 132/213.1 |
| 2,858,835 | A | * | 11/1958 | Parziale | 132/213.1 |
| 3,205,903 | A | | 9/1965 | Anthony | |
| 3,277,902 | A | * | 10/1966 | Korst | 132/150 |
| 3,382,877 | A | | 5/1968 | Cercone | |
| 3,536,080 | A | * | 10/1970 | Legan et al. | 132/213.1 |
| 3,572,351 | A | * | 3/1971 | Perry | 132/213.1 |
| 3,638,665 | A | * | 2/1972 | Staffas, Sr. | 132/129 |
| 4,368,745 | A | | 1/1983 | McGuffey | |
| 4,381,015 | A | * | 4/1983 | Harvath | 132/213.1 |
| 4,401,129 | A | * | 8/1983 | Luque | 132/213.1 |
| 4,830,031 | A | * | 5/1989 | Quinones et al. | 132/214 |
| 4,926,891 | A | * | 5/1990 | Fani et al. | 132/214 |
| 5,067,502 | A | * | 11/1991 | D'Orsi et al. | 132/213.1 |
| 5,213,116 | A | * | 5/1993 | Stein | 132/213.1 |
| 5,349,971 | A | | 9/1994 | Player | |
| 5,456,273 | A | * | 10/1995 | Tungpagasit | 132/213.1 |
| 5,937,868 | A | * | 8/1999 | Ogunro | 132/213.1 |
| 6,079,421 | A | * | 6/2000 | Tafoya | 132/213.1 |
| D428,669 | S | * | 7/2000 | Lucero | D28/25 |
| 6,526,663 | B1 | | 3/2003 | Simmons | |
| 8,443,815 | B2 | * | 5/2013 | Regalado et al. | 132/148 |
| 2011/0146084 | A1 | * | 6/2011 | Melton et al. | 30/233.5 |
| 2014/0137886 | A1 | * | 5/2014 | Fukushima | 132/213.1 |

OTHER PUBLICATIONS

EPO Examination Report.

* cited by examiner

COMB

CROSS-REFERENCE TO RELATED APPLICATIONS

This application is the U.S. national stage of international patent application PCT/EP11/67814, filed Oct. 12, 2011.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION (1) Field of the Invention

The present invention relates to a comb for styling hair. In particular, it relates to a comb for use in conjunction with a pair of scissors or a set of clippers when dressing or cutting the hair of a person.

(2) Description of Related Art

Various combs are disclosed in French Patent No. 1233653 and in U.S. Pat. Nos. 1,347,260, 1,440,015, 1,457,726, 1,891,303, 2,638,907, 3,205,903, 3,382,877, 4,368,745 and 5,349,971. A comb and a pair of scissors, or a comb and a set of clippers (hereinafter referred simply as "scissors" or "clipper(s)" respectively) are separate devices which are used together to cut or dress hair. A skilled hairdresser will have one device in each hand and will use both devices to work together on the person's hair. However, as each is a separate device, there is no system or means for interacting between the two devices, e.g. comb and scissors, or comb and clippers, except for the skill and manual dexterity of the hairdresser.

Essential techniques such as 'scissors-over-comb' and 'clipper-over-comb' are used in traditional hairdressing and barbering. These techniques allow hairdresser and/or barbers to cut close to the head, following the hairline for a soft appearance rather than a freshly-shaven look that is normally achieved using clippers on their own. The advantage of these techniques is that they enable the hairdresser or barber to cut difficult to reach areas much shorter than would be possible if they were picking the hair up with their fingers. Both techniques are difficult to master.

The 'scissors-over-comb' technique requires the hairdresser to hold the lower or stationary blade of the scissors in such a way that it is parallel to the comb. Any one of incorrect positioning, movement in either the scissors or comb or inability to open and close the blades of the scissors completely results in choppy and uneven haircuts. The 'clipper-over-comb' technique requires that a hairdresser or barber moves the clipper up over the surface of the comb to cut any hairs that protrude between the teeth or tines of the comb. The most frequent problem that occurs when the hairdresser or barber is using this technique is slippage, whereby the clippers slip off the bottom edge of the comb making an indentation in the hair which results in a line in the finished haircut. Incorrect positioning and/or movement in the clippers or comb also result in uneven haircuts.

The object of the invention is to alleviate the above disadvantage.

BRIEF SUMMARY OF THE INVENTION

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

The present invention provides a comb comprising an elongate spine, a plurality of tines extending from the spine, and guide means for use in association with a scissors or a clippers.

Advantageously, the guide means acts as a guide for the scissors or clippers to slide along when both are used together by a user when dressing or cutting the hair of a subject. The guide means provides support to a user when performing traditional hairdressing techniques such as 'scissors-over-comb' and/or 'clipper-over-comb' techniques.

Preferably, the guide means comprises a rail extending along a portion of the length of the spine, wherein the rail acts as a guide for the scissors or clippers to slide along. The advantage of this is that it allows a user to build their confidence and skill when performing traditional hairdressing techniques, problems such as slippage do not occur.

Conveniently, the guide means or rail extends transversely from the spine to form a shelf like structure gradually extending from the surface which is generally transverse to the longitudinal axis of the spine. Advantageously, the shelf allows the clippers to glide along the length of the guide means or rail in a smooth motion.

In one embodiment of the invention the shelf like structure is tapered in three dimensions, the shelf extending from a first end towards a second end along at least a portion of the length of the spine, and from the surface which is generally transverse to the longitudinal axis of the spine to a widest point. In a further embodiment of the invention the widest point is closer to the second end of the shelf than the first end of the shelf. This further prevents the clippers from slipping off the comb.

In one embodiment of the invention the guide means, rail or shelf are integrally formed within the structure of the comb.

Alternatively, in a further embodiment of the invention, the guide means, rail or shelf are detachably mountable along the spine of a comb to provide the same function as a guide means, rail or shelf integrally formed within the structure of the comb.

The improved comb of the invention provides many advantages to the user. The guide means, rail or shelf improves the steadiness of a clippers or scissors when used in conjunction with the improved comb. In particular, the guide means, rail or shelf keeps scissors steady when the opening and closing action of the scissors is being effected by the user. The guide means, rail or shelf supports the bottom or stationary edge of the scissors whilst the cutting edge of the scissors moves freely. Movement of the comb through the hair causes movement of the scissors through the hair. The scissors and improved comb of the invention work together in synergy as the user moves through the hair, enabling the user to cut the hair in a smooth fluid motion. This provides a user with greater control, precision and speed. Greater precision as the comb moves through the hair removes problems such as graduation or lines through the haircut. Improving the steadiness of the clippers or scissors has the further advantage of overcoming any movement in a user's hand that may be brought about due to fatigue or the like.

Also, the guide means, rail or shelf serves to guide the clippers or scissors along the comb and around the hairline of the subject. The advantage of this is that greater precision is achieved particularly in difficult areas such as around the bottom edge or baseline of the hair, neck tapering, the temple line and so forth.

Additionally, guide means, rail or shelf also provides a means for a user to have the scissors and/or clippers correctly positioned over the comb. In this way, the rear of the scissors is also guided to its correct position. This has the additional benefit of reducing fatigue for the user. Correct positioning of both the scissors and clippers, eliminates in and out arm movements of the user which normally occur when performing these techniques.

Furthermore, the invention helps to prevent an inverted comb from over positioning whilst the scissors or clippers is over the comb when positioned vertically over the shelf. It also helps to prevent over tilting of the clippers whilst over combing, as well as stopping the clippers from slipping off the bottom of the comb.

Certain advantages also follow from the shape of the shelf which acts as a guide. It allows the elbow of the user to be in a relaxed position thereby improving the comfort of the user. It allows the user's wrist to sweep without the elbow of the user being raised. The shape of the shelf is finished at the end of the comb, so the scissors posture is relaxed and in a natural position. It is also tapered into the comb to aid smooth synergy when combing together with the scissors or clipper.

Additionally, the first and second ends of the shelf are finished to give adequate space for tapering in upward motions in a pendulum like action with clippers for baseline and neck tapering of the subject. It also gives protection in between the ear and the scissors or clippers when working around this area of the subject. The shelf gives extra guidance when tapering down the hair line and around the temple lines of the subject as well as giving guidance when grading or shaving out the front hairline of the subject.

In one embodiment of the invention a hollow core is provided in the section thickness behind guide means. The advantage of the hollow core is that it provides additional comfort for the subject when the comb is being used to protect the ear.

Furthermore, the comb stops the scissors' up and down movement and minimises the scissors' or clippers' inward and outward movements. The comb also helps improve the thumb action of the user whilst a scissors over comb procedure is being performed.

Preferably, the comb is formed from a suitable material selected from a group of polymeric compounds known to a person skilled in the art, which give the comb of the invention suitable performance characteristics required for the functionality of the invention for example, stiffness, heat and chemical resistance, suitable weight and cost effectiveness. An example of a suitable polymeric compound is polyoxymethylene (POM). A further example of such a compound is polypropylene (PP). In a further embodiment of the invention the polymeric compound is combined with a suitable copolymer to improve the required properties of the comb once formed as determined by a person skilled in the art. Ideally, the comb is finished with a high quality smooth surface to enable a scissors or clippers to glide over the guide means.

BRIEF DESCRIPTION OF THE SEVERAL VIEWS OF THE DRAWINGS

The invention will hereinafter be more particularly described with reference to the accompanying drawings, which show by way of example only, one embodiment of a comb according to the invention. In the drawings.

DETAILED DESCRIPTION OF THE INVENTION

Figure 6:
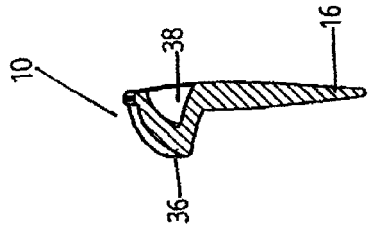
FIG. 6 is an enlarged cross-sectioned view taken along the line A-A of FIG. 2.
Figure 5:
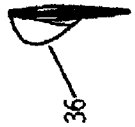
FIG. 5 is an end view of the comb.
Figure 1:
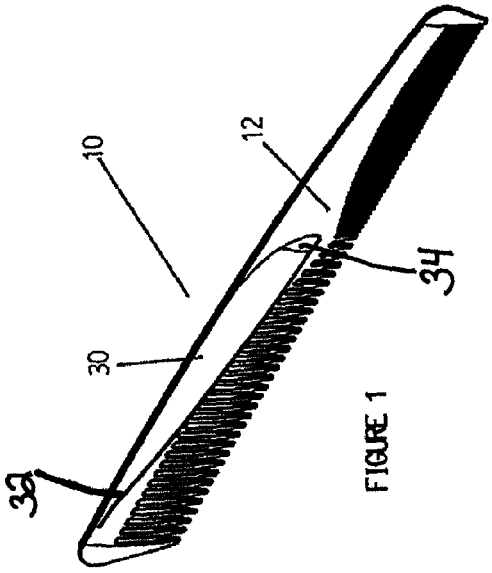
FIG. 1 is a perspective view of the comb from a first side and from above.
Figure 2:
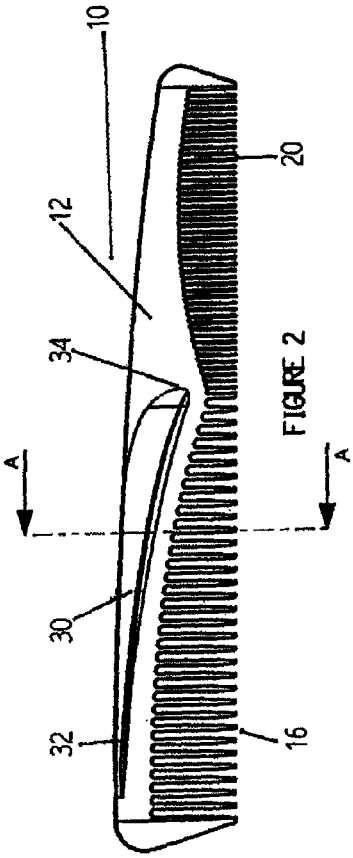
FIG. 2 is an elevational view of one side of the comb.
Figure 3:
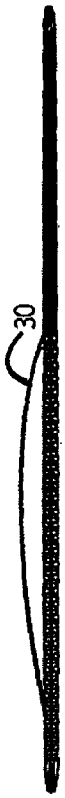
FIG. 3 is a plan view of the comb from above.
Figure 4:
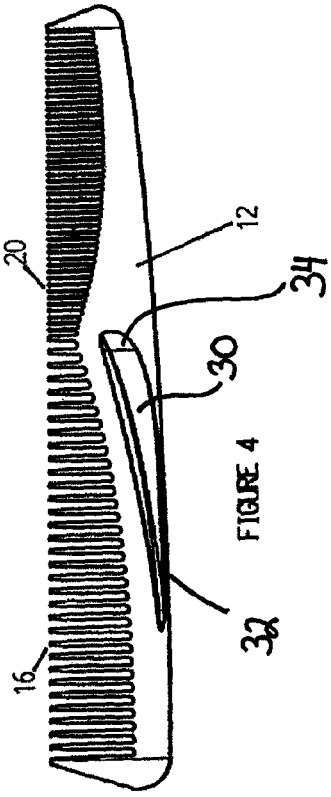
FIG. 4 is an elevational view of the other side of the comb.

Referring to the drawings, and initially to FIGS. 1 to 6, there is shown a comb 10 of the invention comprising a spine 12, a first set of tines 16 and a second set of tines 20.

Extending from the spine 12, over the first set of tines 16, is guide means in the form of a transverse shelf 30 which is tapered in three dimensions from its first end 32 towards its second end 34 with its widest point 36 being closer to the second end 34 than the first end 32. Guide means or transverse shelf 30 act as a guide for the scissors or clippers to slide along when both are used together by a user when dressing or cutting the hair of a subject as shown in FIGS. 7 to 11. The scissors and clippers are supported by guide means or transverse shelf 30 as the user performs traditional hairdressing techniques such as 'scissors-over-comb' and/or 'clipper-over-comb'. Certain advantages also follow from the shape of the shelf 30. It allows the elbow of the user to be in a relaxed position thereby improving the comfort of the user. It allows the user's wrist to sweep without the elbow of the user being raised. The shape of the shelf is finished at the second end 34 of the comb, so the scissors posture is relaxed and in a natural position. It is also tapered into the comb to aid smooth synergy when combing together with the scissors or clipper.

Transverse shelf 30 is integrally formed within the structure of the comb 10, the transverse shelf 30 being formed within spine 12. As shown in FIG. 6, a hollow core 38 is provided in the section thickness behind the shelf 30. The advantage of hollow core 38 is that it provides additional comfort for the subject when the comb 10 is being used to protect the ear.

In an alternative arrangement not shown in the drawings, the shelf 30 is detachably mountable on a standard comb to provide the same functions as a comb with an integrally formed shelf. The shelf 30 is clipped onto the comb or detachably mounted in any other similar manner to provide a positive engagement with the comb.

The comb 10 of the invention is formed from a suitable material selected from a group of polymeric compounds known to a person skilled in the art, which give the comb of the invention suitable performance characteristics required for the functionality of the invention for example, stiffness, heat and chemical resistance, suitable weight and cost effectiveness. Examples of suitable polymeric compounds are polyoxymethylene (POM) or polypropylene (PP). In a further embodiment of the invention the polymeric compound is combined with a suitable co-polymer to improve the required properties of the comb 10 once formed as determined by a person skilled in the art. The comb is finished with a high quality smooth surface to enable a scissors or clippers to glide over the shelf 30.

Use of the comb can provide the advantages as outlined earlier in this description.

Figure 7:
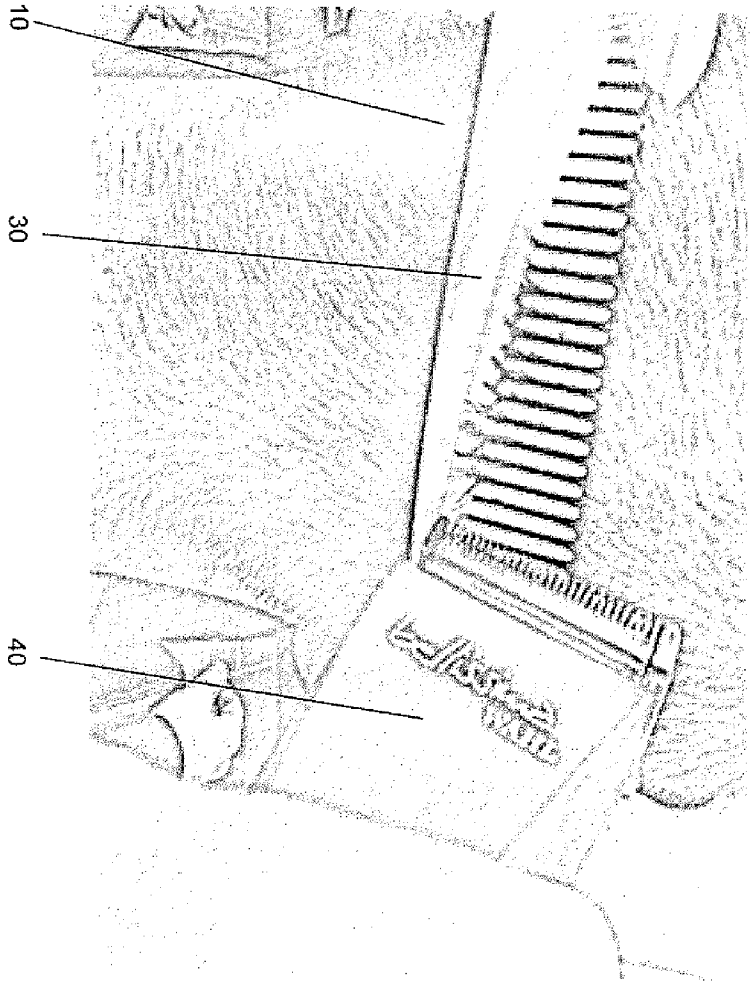
FIGS. 7 and 8 are two perspective views of the comb being used in conjunction with a clippers on a subject.
Figure 8:
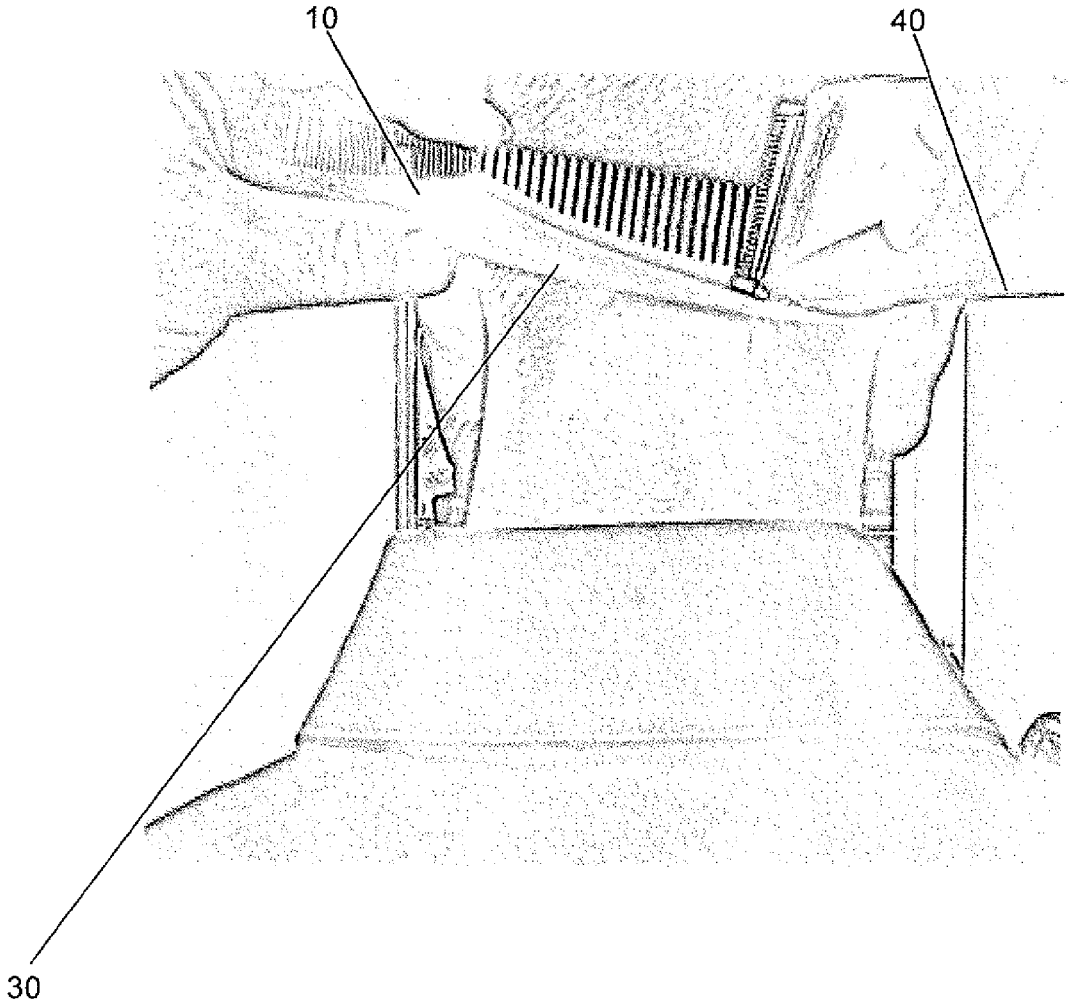

Referring now to FIG. 7, the comb 10 is being used in conjunction with the clippers 40 which is supported on the shelf 30 as the clippers 40 is moved in a horizontal direction adding smoothness to the action. The view shown in FIG. 8 illustrates the level of protection that the comb 10 provides while the user is tapering the hairlines of the subject and also aids the user when styling around the subject's ears, temple lines and side burns. Guide means or shelf 30 improves the steadiness of the clippers 40 when used in conjunction with comb 10. The first and second ends 32 and 34 of the shelf 30 are finished to give adequate space for tapering in upward motions in a pendulum like action with clippers 40 for baseline and neck tapering of the subject.

Figure 9:
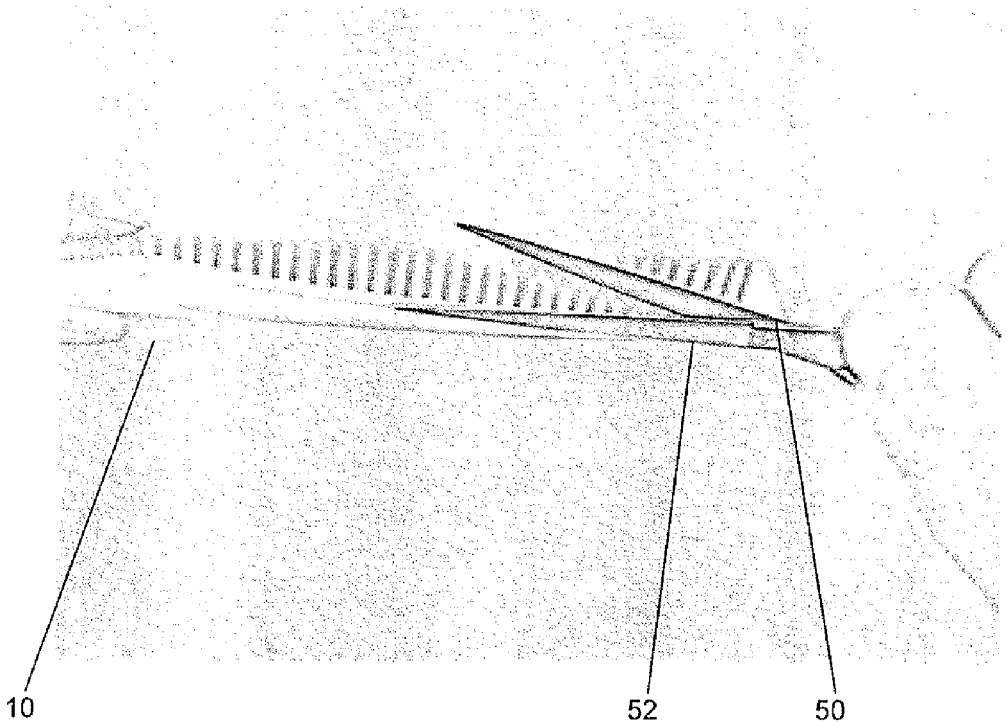
FIGS. 9, 10 and 11 are three perspective views of the comb being used in conjunction with a scissors.
Figure 10:
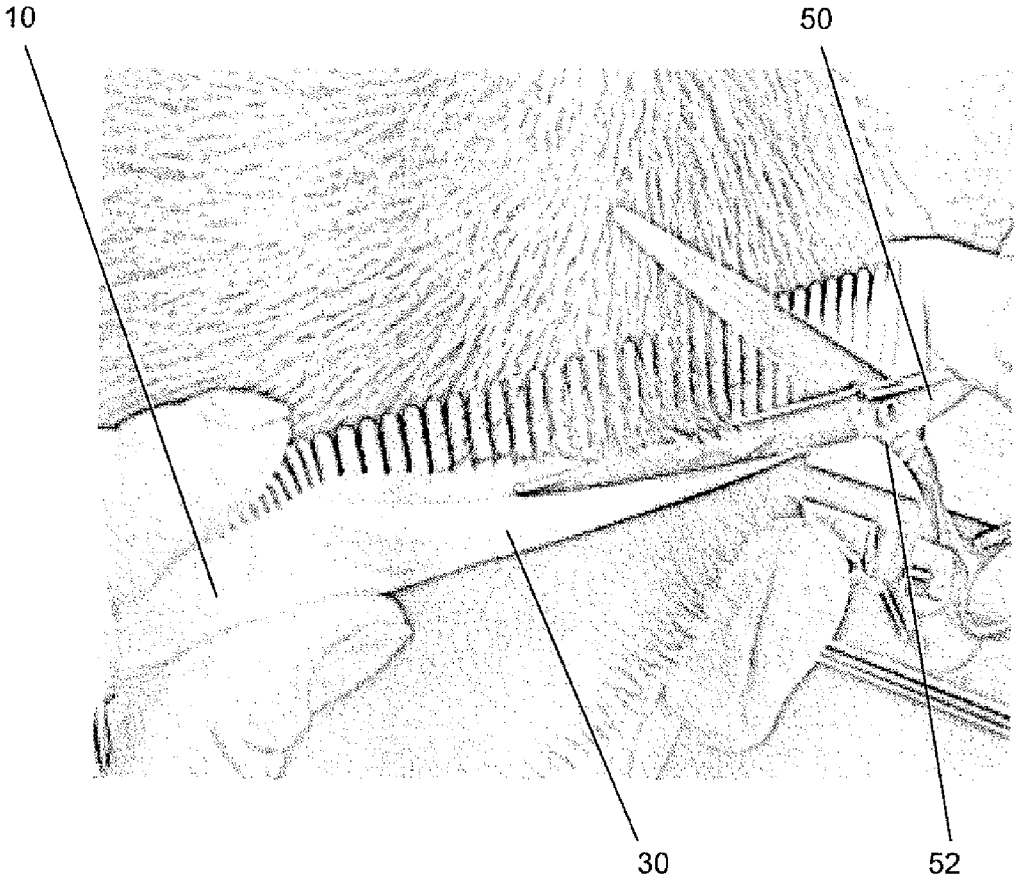
Figure 11:
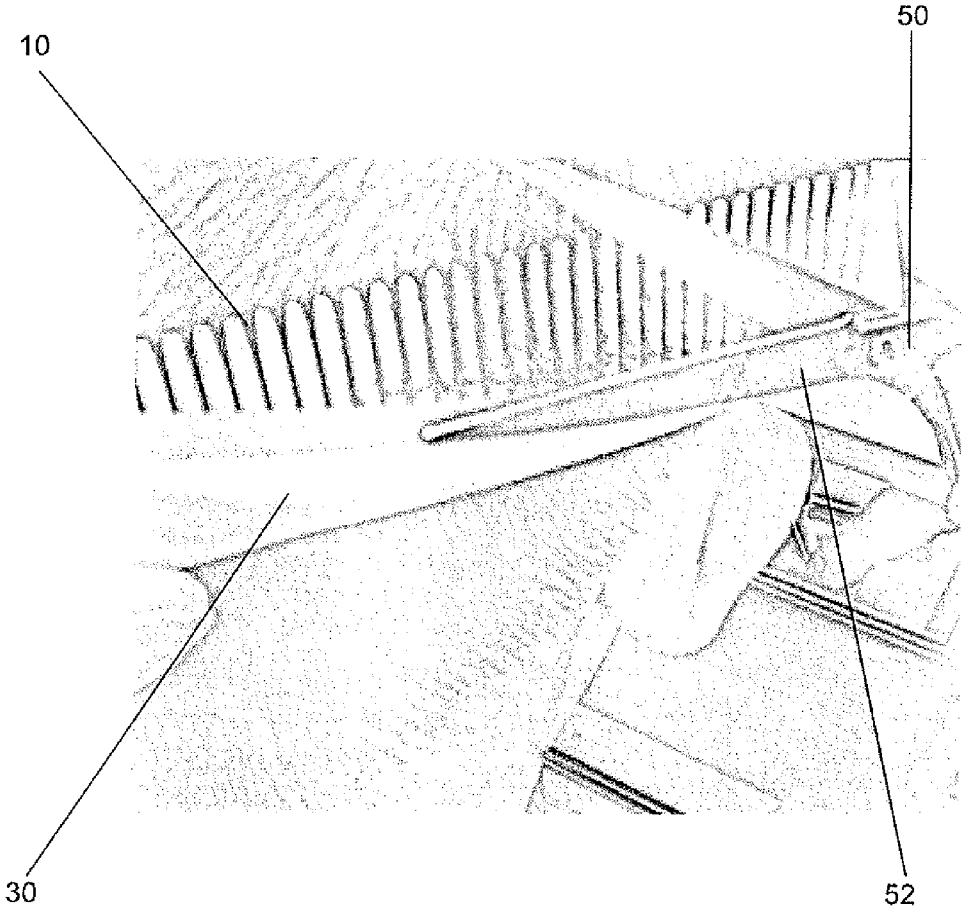

Referring now to FIGS. 9, 10 and 11, there are shown a various views of the comb 10 of the invention in use with a scissors 50. The shelf 30 of the comb 10 is used to support the bottom or stationary blade 52 of the scissors 50 held by the first three fingers of the user while allowing the thumb to open and shut the scissors 50 thereby minimising any movement in the hand action leading to a steadier and more precise cut. The scissors 50 and comb 10 of the invention work together in synergy as the user moves through the hair, enabling the user to cut the hair in a smooth fluid motion. FIGS. 10 and 11 show the action of performing the "scissors over comb" support and also illustrate the strong resistance to inverting the comb.

It is to be understood that the invention is not limited to the specific details described herein which are given by way of example only and that various modifications and alterations are possible without departing from the scope of the invention.

The invention claimed is:

1. A comb (10) configured to enable a user to achieve a scissors-over-comb or clippers-over-comb cutting action so that a user can cut a person's hair following the hairline to achieve a soft appearance rather than a shaven look, the comb (10) comprising an elongate spine (12) and a plurality of tines (16, 20) extending from the spine (12), characterised in that the comb (10) further comprises a guide (30) for scissors (50) or clippers (40) to slide along when cutting hair thereby facilitating steadiness of the scissors (50) or clippers (40), wherein the guide (30) extends along a portion of the length of the spine (12), wherein the guide (30) extends transversely from the spine (12) to form a shelf-like structure gradually extending from the spine (12) which enables a user to have the scissors or clippers correctly positioned over the comb (10) when performing scissors-over-comb or clipper-over-comb cutting action, the guide (30) having a first end (32) and an opposite second end (34), the guide (30) having a shape that is tapered in three dimensions from the first end (32) towards the second end (34) along said portion of the length of the spine (12), wherein the guide (30) has a widest point (36) positioned closer to the second end (34) of the guide (30) than the first end (32) of the guide (30), wherein a section thickness behind the shelf-like structure (30) has a hollow core (38), the guide (30) being integrally formed along the spine (12).

2. A comb (10) configured to enable a user to achieve a scissors-over-comb or clippers-over-comb cutting action so that a user can cut a person's hair following the hairline to achieve a soft appearance rather than a shaven look, the comb (10) comprising an elongate spine (12) and a plurality of tines (16, 20) extending from the spine (12), characterised in that the comb (10) further comprises a guide (30) for scissors (50) or clippers (40) to slide along when cutting hair thereby facilitating steadiness of the scissors (50) or clippers (40), wherein the guide (30) extends along a portion of the length of the spine (12), wherein the guide (30) extends transversely from the spine (12) to form an arcuate shelf-like structure gradually extending from the spine (12) which enables a user to have the scissors or clippers correctly positioned over the comb (10) when performing scissors-over-comb or clipper-over-comb cutting action, the guide (30) having a first end (32) and an opposite second end (34), the guide (30) having a shape that is tapered in three dimensions from the first end (32) towards the second end (34) along said portion of the length of the spine (12), wherein the guide (30) has a widest point (36) positioned closer to the second end (34) of the guide (30) than the first end (32) of the guide (30), wherein a section thickness behind the arcuate shelf-like structure (30) has a hollow core (38), the guide (30) being integrally formed along said portion of the length of the spine (12).

* * * * *